US005345746A

United States Patent [19]

Franchi

[11] Patent Number: 5,345,746

[45] Date of Patent: Sep. 13, 1994

[54] METHOD FOR REGULATING THE AMOUNT OF ANTI-BACTERIAL AGENT IN STERILE PACKAGING PROCESSES

[76] Inventor: Richard M. Franchi, 264 Shagbark Dr., Derby, Conn. 06418

[21] Appl. No.: 57,515

[22] Filed: May 6, 1993

[51] Int. Cl.[5] ..... B65B 55/02

[52] U.S. Cl. ..... 53/431; 53/425; 53/440

[58] Field of Search ..... 53/425, 426, 440, 431, 53/428, 127, 469, 401, 400; 206/205; 604/304; 422/294

[56] References Cited

U.S. PATENT DOCUMENTS

| | | | |
|---|---|---|---|
| 3,725,003 | 4/1973 | Moore et al. | 53/425 X |
| 3,754,368 | 8/1973 | Moore et al. | 53/425 X |
| 3,857,677 | 12/1974 | Moore et al. | 53/425 X |
| 4,998,400 | 3/1991 | Suzuki et al. | 53/440 X |
| 5,044,141 | 9/1991 | Franch | 53/440 X |

*Primary Examiner*—James F. Coan

[57] ABSTRACT

A method of regulating the amount of anti-bacterial agent in sterile packaging processes within the package which involves the steps of partially filling a container with any of a number of anti-bacterial agents in a solution of liquid, semi-liquid or frozen form, then placing articles into the container, so that an air space is formed within the container partially dehumidifying the air so that when the container is sealed the heating of the container and its contents to a temperature substantially below the boiling point of the solution and at a pressure of about one atmosphere, the surface within the container above and below the solution level, and the entire contents of such container, are sterilized, and have a regulated amount of anti-bacterial agent present in the air space.

27 Claims, No Drawings

METHOD FOR REGULATING THE AMOUNT OF ANTI-BACTERIAL AGENT IN STERILE PACKAGING PROCESSES

BACKGROUND OF THE INVENTION

U.S. Pat. Nos. 3,857,677 and 3,725,003 disclose a method for the sterile packaging of articles sealed in containers. These patents rely only on heating the contents of the sealed container, including the anti-bacterial agent, to a temperature substantially below the boiling point in order to obtain complete sterilization of the inner surfaces of the container, which includes the surfaces in the air space. The reason that the surfaces in the air space become sterilized is that during the heating of the container and its contents the air inside the package becomes humidified with the aqueous solution that has an anti-bacterial agent in it. Therefore, the anti-bacterial agent becomes present in the air/gas and performs the sterilization process. If the sterilizing agents were not present in the air such low temperatures and pressures as disclosed in these patents would not produce a sterile condition.

There has been previous attempts to sterilize using a similar process with only water and saline being present in the liquid. This was disclosed in U.S. Pat. No. 3,754,368. This patent discloses that the time necessary for sterilization with water and/or saline is longer than if an anti-bacterial agent is present in the solution.

The problem with these processes as claimed and disclosed is that they do not allow a way to predict when sterility occurs other than actually testing the inside of the container and its contents usually with spore strips that must be incubated after being removed from the container. The result is that the heating process is performed for a time which is much longer than necessary to sterilize or a periodic sterility test must be performed during the heating procedure. The reason that it is difficult to predict when sterility occurs is that the humidity of the air, which is present when the container is sealed, can vary with each container depending on the atmospheric temperature and humidity present at the time the container is sealed. Therefore, the amount of anti-bacterial agent is variable because it is contained only in the aqueous solution and can only be placed in the air space by raising the humidity level in said space. As an example, using the same solution and anti-bacterial agent, if the atmospheric air which becomes sealed in the container is at 70° F. and 40% relative humidity is heated to 120° F. during the heating process for four hours, the amount of additional humidity received from the aqueous solution in the container is different from a container which is sealed at a time when atmospheric air is 80° F. and 80% relative humidity for the same heating cycle. Thus, the amount of anti-bacterial agent in the air space is different for each container.

Another problem which becomes apparent with the method of sterile packaging disclosed in U.S. Pat. No. 3,857,677 and 3,725,003 is that it allows the method of wetting articles as disclosed in U.S. Pat. No. 5,044,141 to be an inconsistent procedure. This is because the condensed solution which wets the surfaces above the liquid contains varying amounts of anti-bacterial agent which again depends on the atmospheric air temperature and humidity present at the time of sealing the container. This variation in the amount of anti-bacterial agent hinders the effectiveness of the wetting procedure disclosed.

SUMMARY OF THE INVENTION

The main aspect of this invention concerns a method of regulating the amount of anti-bacterial agent present in the air space inside a container during the sterilization processes as disclosed in U.S. Pat. Nos. 3,857,677, No. 3,725,003 and No. 5,044,141.

This invention allows a way of controlling how long it takes for sterilization to occur with precision and will eliminate the need for testing to be performed during the heating process to check for consistent results in the wetting of articles as disclosed in U.S. Pat. No. 5,044,141 because the amount of anti-bacterial agent being condensed is consistent or known every time the heat process is performed.

The invention in this application involves the steps of partially filling a bottle, bag or other sealable container with a liquid-solution, semi-liquid, or frozen solution containing an anti-bacterial agent (some standard anti-bacterial agents are solutions of iodine (iodofor), halogenated bis-phenols, such as hexachlorophene, quaternary ammonium salts such as benzalkonium chloride, and sodium ethylmercurithiosalicylate, placing in the container those items to be sterilized, then the air or gas in the container is partially dehumidified either before or after it is sealed inside the container. After the container is sealed and the air or gas is partially dehumidified the container and its contents are heated to a temperature well below the boiling point of the liquid and at a pressure of about one atmosphere. In general, the temperature to which the container and its contents are heated will be within the range of about 115° to 210° F.; but usually below 180° F., the particular temperature selected depending on the anti-bacterial agent used and the duration of the heating step necessary to raise temperature and humidity in the container to provide the minimum required amount of anti-bacterial agent in the air space. The heating operation is continued for a period of time known to kill all organisms including spores.

DESCRIPTION OF THE INVENTION

Some methods of the sterilization process and anti-bacterial agents used in connection with the present invention have been disclosed in U.S. Pat. No. 3,725,003, No. 3,857,677 and No. 5,044,141.

The anti-bacterial agents used in connection with the present method are conventional. Of the numerous agents known to have anti-bacterial properties and which are believed suitable for use in connection with the invention, several have been previously disclosed in the aforementioned U.S. Patents. On the basis of this previous disclosure of anti-bacterial agents, it is believed that the following general conditions are applicable.

Where the anti-bacterial agent is sodium ethylmercurithiosalicylate in aqueous solution, a concentration within the range of 1:100 to 1:2000 has been found effective. The air should be partially dehumidified to a range of 30% to 40% relative humidity at 60° F. before sealing the container or the entire package and its contents should be cooled to 50° F. for two hours after it is sealed or the aqueous solution should be frozen into a cube and placed into the container with the articles to be sterilized and then sealed and allowed to cool the contents of the container for at least 3 hours. Next the heating step should exceed 12 hours at a temperature within the range of about 160° to 210° F.

For hexachlorophene, a halogenated 2,2'-bisphenol, the aqueous solution should have a concentration within the range of about 0.25 to 4.0 percent. The air should be partially dehumidified to a range of 30% to 40% relative humidity at 60° F. before sealing the container or the entire package and its contents should be cooled to 50° F. for 2 hours after it is sealed or the aqueous solution should be frozen into a cube and placed into the container with the articles to be sterilized and then sealed and allowed to cool the contents of the container for at least 3 hours. Next the container and its container should be heated at a temperature within the range of about 160° to 210° F. for an interval exceeding 12 hours.

Quaternary Ammonium surface-active disinfectants have also been found effective. Thus, benzalkonium chloride in aqueous solution having a concentration falling within the range of 0.0025 to 0.2 percent may be used. The air should be partially dehumidified to a range of 30% to 40% relative humidity at 60° F. before sealing the container or the entire package and its contents should be cooled to 50° F. for 2 hours after it is sealed or the aqueous solution should be frozen into a cube and placed into a container with the articles to be sterilized and then sealed and allowed to cool the contents of the container for at least 3 hours. Next the container and its contents should be heated to a temperature in the range of about 150° to 210° F. for a period exceeding 12 hours.

Iodine preparations or complexes which liberate free iodine in aqueous solution are highly effective for use in connection with the method of this invention. An aqueous iodophor solution having an iodine concentration within the range of 0.0012 to 3.0 percent is suitable. The air should be partially dehumidified to a range of 30% to 40% relative humidity at 60° F. before sealing the container or the entire package and its contents should be cooled to 50° F. for 2 hours after it is sealed or the aqueous solution should be frozen into a cube and placed into a container with the articles to be sterilized and then sealed and allowed to cool the contents of the container for at least 12 hours. Next the container and its contents should be heated to a temperature in the range of 115° and 150° F. for a period in excess of 2 hours.

Sterilization occurs by the end of the heating cycle. The minimum amount of the anti-bacterial agent is present in the air space because of the regulation of the humidity of the air before the heating process begins. Normally, the space above the liquid in the container will be filled with air; however other gases might be substituted if desired.

Some of the specific applications for the operative procedures are detailed in the following examples:

EXAMPLE I

The air is dehumidified to 40% relative humidity at 65° F. An aqueous solution of a quaternary ammonium salt with a concentration of about 1:750 partially fills a flexible container and then a swabstick is placed in the container, The container is then sealed and an air space is formed above the liquid in the container. The container and its contents are then heated to 170° F. for 24 hours.

EXAMPLE II

An aqueous solution of liquid hexachlorophene with a concentration of 30% partially fills a flexible container and then a swabstick is placed in the container. The container is then sealed and an air space is formed above the liquid in the container while the swabstick remains partially in the air space. The container and its contents are cooled to 55° F. for 4 hours. The container and its contents are then heated to 175° F. for 24 hours.

EXAMPLE III

An aqueous solution of sodium ethylmercurithiosalicylate with a concentration of 1:1000 is cooled to 40° F. and then is placed into a container and partially fills it and then a swabstick is placed in the container, The container is then sealed and an air space is formed above the liquid in the container while the swabstick remains partially in the air space. The container and its contents are allowed to cool from the aqueous solution for 3 hours. The container and its contents are then heated to 175° F. for 24 hours while maintaining a pressure of about one atmosphere.

EXAMPLE IV

An aqueous solution of sodium ethyl mercurithiosalicylate with a concentration of 1:1000 is frozen into a cube and placed into a container partially filling it and then a swabstick is placed in the container. The container is then sealed and an air space is formed around the frozen cube in the container while the swabstick remains partially in the air space. The container is then sealed and allowed to cool from the frozen cube for 8 hours until the cube is melted. The container and its contents are then heated to 175° F. for 24 hours while maintaining a pressure of about one atmosphere.

BEST MODE OF THE INVENTION

The air is dehumidified to 40% relative humidity at 60° F. An aqueous solution of an iodophor which results in a solution having a 0.23 percent of free iodine partially fills a flexible container and then a sponge is placed in the container. The container is then sealed and an air space is formed above the liquid in the container while the sponge remains partially in the air space. The container and its contents are then heated to 140° F. for 24 hours while maintaining a pressure of about one atmosphere. Noted is the fact that the anti-bacterial solutions can contain soap in the aqueous solution.

While in the foregoing I have disclosed the method of the invention in considerable detail for the purpose of illustration, it will be understood by those skilled in the art that many of the details may be varied without departing from the spirit and scope of the invention.

What is claimed is:

1. A method of regulating the amount of anti-bacterial agent in sterile packaging processes comprising the steps of partially filling a container with a solution of a standard anti-bacterial agent; then placing an article in the container; then sealing said container to provide a gas space above the solution within the sealed container; then cooling the entire contents of the container until the gas space is partially dehumidified; then heating said container and its contents to a temperature substantially below the boiling point of the solution and at a pressure of about one atmosphere until all the surfaces inside the container above and below the solution, and the entire contents of the container, are sterilized.

2. The method of claim 1 in which the anti-bacterial agent is selected from the group consisting of iodophor, sodium ethylmercurithiosalicylate, quaternary ammonium salts, and halogenated bis-phenols.

3. The method of claim 2 in which the container and its contents are cooled to a temperature within a range of 40° F. to 60° F. until the gas inside the container is partially dehumidified and then heated to a temperature within the range of 120° F. to 210° F.

4. The method of claim 2 in which the gas space contains air.

5. The method of claim 2 in which the container and its contents are heated to a temperature within the range of 130° F. to 150° F. for at least 2 hours.

6. The method of claim 1 in which the solution is standard anti-bacterial agent having an available iodine concentration within the range of 0.0012 to 3.0 percent.

7. The method of claim 6 in which the container and its contents are cooled to a temperature within the range of 40° F. to 60° F. until the gas inside the container is partially dehumidified then heated to a temperature within the range of 120° F. to 150° F.

8. The method of claim 1 in which the solution is an aqueous solution of a halogenated 2, 2'-bis-phenol having a concentration within the range of 0.25 to 4.0 percent.

9. The method of claim 1 in which the solution is an aqueous solution of a quaternary ammonium salt having a concentration within the range of 0.0025 to 0.2 percent.

10. The method of claim 1 in which the solution is a solution of sodium ethylmercurithosalicylate having a concentration within the range of 1:100 to 1:2000.

11. The method of claim 2 in which the solution contains soap.

12. A method of regulating the amount of anti-bacterial agent in sterile packaging processes comprising the steps of partially dehumidifying a gas utilized in said sterile packaging processes; then partially filling a container with a solution of a standard anti-bacterial agent; then placing an article in the container; then sealing said container to provide a gas space above the solution within the sealed container; then heating said container and its contents to a temperature substantially below the boiling point of the solution and at a pressure of about one atmosphere until all the surfaces inside the container above and below the solution, and the entire contents of the container, are sterilized.

13. The method of claim 12 in which the anti-bacterial agent is selected from the group of iodophor, sodium ethylmercurithiosalicylate, quaternary ammonium salts, and halogenated bis-phenols.

14. The method of claim 13 in which articles placed in the container are completely above the liquid level of the solution.

15. A method of claim 12 in which the container and its contents are heated to a temperature within the range of 120° F. to 210° F.

16. The method of claim 12 in which the gas space contains air.

17. The method of claim 12 in which the container and its contents are heated to a temperature within the range of 130° F. to 150° F. for at least 2 hours.

18. The method of claim 13 in which the solution contains soap.

19. A method of regulating the amount of anti-bacterial agent in sterile packaging processes comprising the steps of placing a block of frozen solution of a standard anti-bacterial agent in a container; then placing an article in the container; then sealing said container to provide a gas space within the sealed container; then allowing the frozen solution to cool down the gas inside the container until said gas is partially dehumidified, then heating said container and its contents to a temperature substantially below the boiling point of the solution and at a pressure of about one atmosphere until all the surfaces inside the container above and below the solution, and the entire contents of the container, are sterilized.

20. The method of claim 19 in which the anti-bacterial agent is selected from the group of iodophor, sodium ethylmercurithiosalicylate, quaternary ammonium salts, and halogenated bis-phenols.

21. The method of claim 20 in which articles placed in the container are completely above the solution.

22. The method of claim 19 in which the container and its contents are heated to a temperature within the range of 120° F. to 210° F.

23. The method of claim 19 in which the gas space contains air.

24. The method of claim 19 in which the container and its contents are heated to a temperature within the range of 130° F. to 150° F. for at least 2 hours.

25. A method of regulating the amount of anti-bacterial agent in a sterile packaging process comprising the steps of partially filling a container with a solution of a standard anti-bacterial agent; then sealing said container to provide a gas space above the solution within the sealed container; then cooling the entire contents of the container until the gas space is partially dehumidified then heating said container and its contents to a temperature substantially below the boiling point of the solution and at a pressure of about one atmosphere until all the surfaces inside the container above and below the solution, and the entire contents of the container, are sterilized.

26. A method of regulating the amount of anti-bacterial agent in sterile packaging processes comprising the steps of partially dehumidifying a gas utilized in said sterile packaging processes; then partially filling a container with a solution of a standard anti-bacterial agent; then sealing said container to provide a gas space above the solution within the sealed container; then heating said container and its contents to a temperature substantially below the boiling point of the solution and at a pressure of about one atmosphere until all the surfaces inside the container above and below the solution, and the entire contents of the container, are sterilized.

27. A method of regulating the amount of anti-bacterial agent in sterile packaging processes comprising the steps of placing a block of frozen solution of a standard anti-bacterial agent in a container; then sealing said container to provide a gas space within the sealed container; then allowing the frozen solution to cool down the gas inside the container until said gas is partially dehumidified; then heating said container and its contents to a temperature substantially below the boiling point of the solution and at a pressure of about one atmosphere until all the surfaces inside the container above and below the solution, and the entire contents of the container, are sterilized.

* * * * *